United States Patent [19]

Montgomery

[11] Patent Number: 4,537,318

[45] Date of Patent: Aug. 27, 1985

[54] DISPENSING CLOSURE LOCK AND SEAL

[75] Inventor: Gary V. Montgomery, Evansville, Ind.

[73] Assignee: Sunbeam Plastics Corp., Evansville, Ind.

[21] Appl. No.: 607,640

[22] Filed: May 7, 1984

[51] Int. Cl.[3] ..... B65D 41/04

[52] U.S. Cl. ..... 215/232

[58] Field of Search ..... 215/232, 250, 347; 220/359

[56] References Cited

U.S. PATENT DOCUMENTS 3,815,314 6/1974 Pollock ..... 53/15
3,861,549 1/1975 Watson et al. ..... 215/232
4,171,084 10/1979 Smith ..... 215/232 X
4,236,653 12/1980 Gach ..... 222/556 X

*Primary Examiner*—Donald F. Norton
*Attorney, Agent, or Firm*—Fisher, Crampton, Groh & McGuire

[57] ABSTRACT

A lock and seal member for a dispensing package including a container and a dispensing type closure is disposed in a manner to fuse the closure and container permanently together. Removal of the contents of the container requires dispensing through a dispensing passage in the closure while the seal remains in position to lock the closure in permanent position relative to the container and also to form a seal preventing the leakage of materials.

10 Claims, 10 Drawing Figures

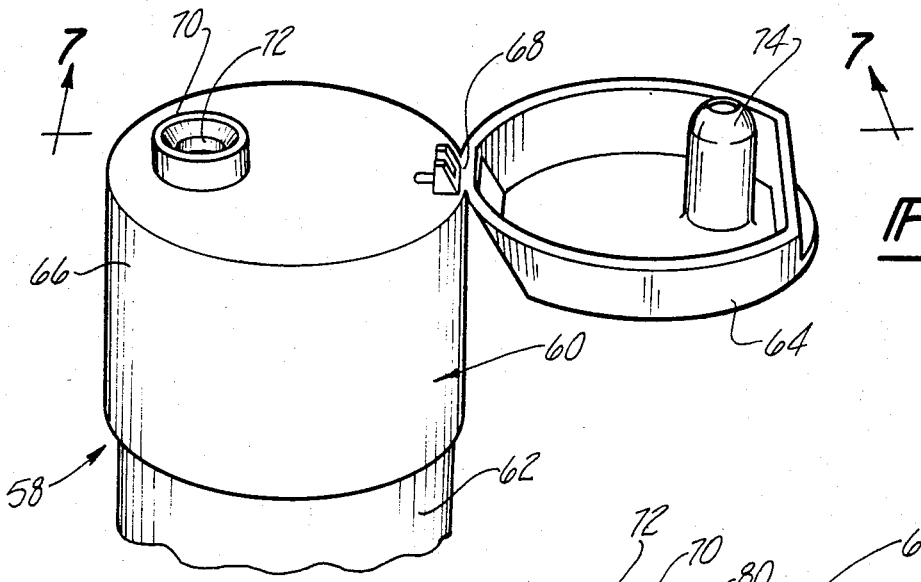
Fig-6
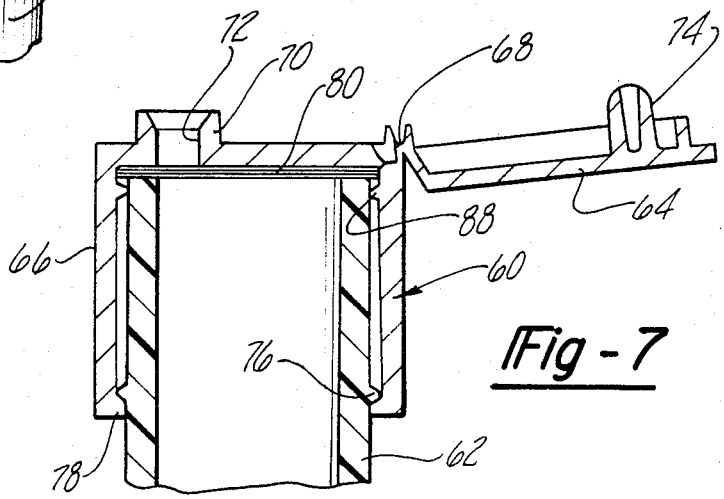
Fig-7
Fig-8
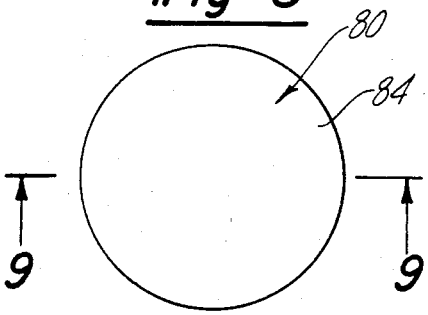
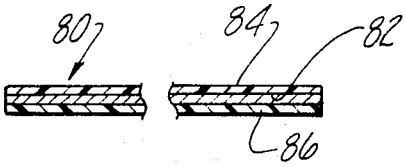
Fig-9
Fig-10
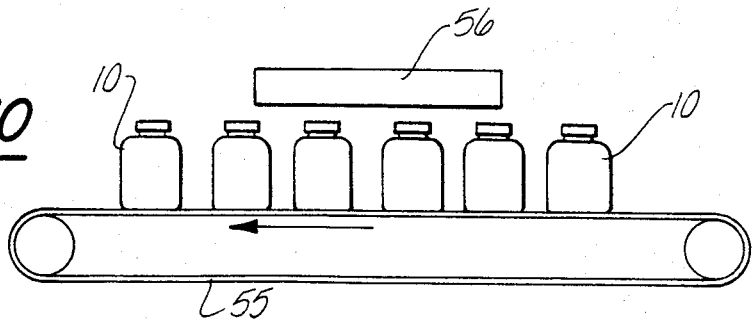

DISPENSING CLOSURE LOCK AND SEAL

This invention relates to packages which include closures and containers and more particularly to packages of the dispensing type in which the contents of the container can be dispensed from the container through a separate passage in the closure.

With certain dispensing packages, the closure is threaded onto the neck of a container and various ratcheting arrangements are used to insure that the cap can be placed on the container but that it cannot be removed by turning in the opposite direction. Removal of the contents of the container then requires dispensing of the contents through a dispensing passage in the closure. The ratchet arrangements require closures and containers with accurate tolerances in order for them to function properly. Unfortunately, as a practical matter, tolerances vary widely so that in some instances, the ratchet arrangement may not be functional to prevent removal of the cap. The variance in tolerances is compounded by the fact that in most instances the closures are made by one manufacturer and the containers, which must be specially made to match the closure, may be made by several different manufactureres, each with its own special problem of meeting the dimensional requirements.

These problems of tolerances and fits also compound the problem of sealing the contents of the container. In many instances, the seals are linerless and are formed integrally as a unit with the closure for engagement with surfaces of the container. The sealing problem becomes particularly acute in the case of some products such as charcoal lighter, which has a very low viscosity and which is contained only by package materials which are difficult to mold smoothly enough to effectively accept a linerless seal to prevent leakage.

In addition to the problem created by the requirements of ratchet teeth and linerless closures, standard bottle finishes usually must be modified to accept the dispensing closure which becomes costly and usually limits the user to only one closure.

Some of these problems are further aggravated when the dispensing cap or closure is made of one material and the container is made of still another material.

In an effort to overcome some of these problems, some dispensing caps have heretofore been permanently attached to containers by such methods as sonic welding and spin welding. In such processes, however, it is necessary to at least temporarily stop movement of the container in a movable production line to bring about the necessary welding of the closure and container. Moreover, such processes are best suited to packages in which the container and closure are made of like materials. Even then, the seal between the closure and container is not always effective as a liquid seal for liquids of low viscosity.

The present invention contemplates the seal arrangement and method of using it whereby a dispensing closure is permanently attached to a container through the medium of a lock and seal element which not only forms a fluid tight seal but also acts to permanently connect the closure to the container. The lock and seal element of metallic material with opposite sides coated with fusible plastic materials which will fuse with similar materials making up or coating the critical surfaces of the mating closure and container. The permanent attachment of the closure and container through the lock and seal element eliminates the need for complementary ratchet teeth and lugs on the closure and on the container as well as the need for specially formed surfaces to provide the function of a seal which is effective even with low viscosity of liquids.

The closure is provided with a separate dispensing opening and in one embodiment the lock and seal elements is in the form of an annular ring which is sandwiched between the closure and the container so the contents of the container must be dispensed through the ring and the dispensing passage. In another embodiment of the invention, the lock and seal element is in the form of a disc completely closing the opening to the container and so positioned in proximity to the dispensing passage in the closure that it must be punctured to complete an opening to the container. This forms a tamper indicating feature since the ultimate customer becomes aware through warning messages that if the seal is broken and the passage is open, there has been a prior opening and possible tampering.

Preferred embodiments of the invention are disclosed in the drawings in which:

FIG. 6 is a perspective view of a package of the type incorporating another embodiment of the invention;

FIG. 7 is a cross sectional view taken generally in line 7—7 in FIG. 6;

FIG. 8 is a plan view of the lock and sealing element embodied in the package shown in FIG. 7, FIG. 9 is a cross-sectional view taken generally on line 9—9 in FIG. 8; and FIG. 10 is a diagrammatic elevation of induction heating equipment used in applying the lock and seal element to a package.

Figure 1:
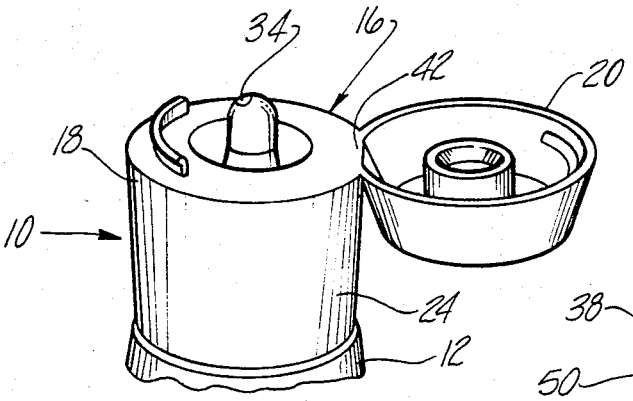
FIG. 1 is a perspective view of a one piece dispensing closure of a type embodying the invention.
Figure 2:
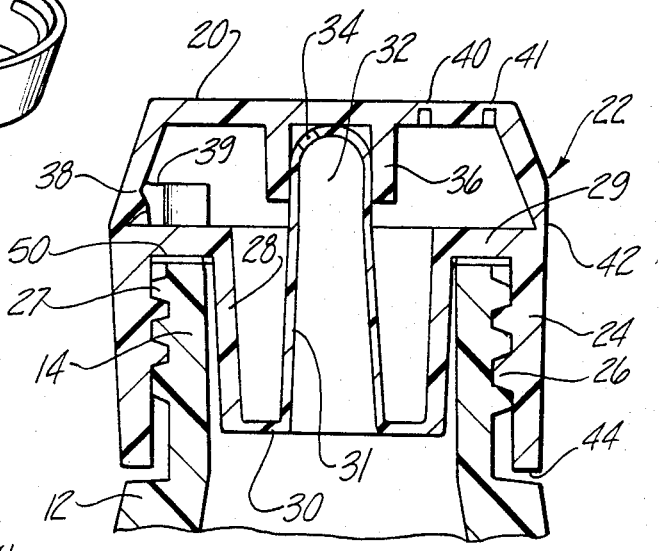
FIG. 2 is a cross-sectional view at an enlarged scale of the closure in FIG. 1 in a closed condition.

Referring to the drawings, the invention as shown embodied in a package 10, including a container 12 having a neck portion 14 which receives and supports a closure assembly 16.

The closure 16 comprises an inverted cup-shaped cap 18 and a lid 20 which are hingedly connected to each other by a double acting hinge generally indicated by the reference character 22.

The cap 18 has a depending cylindrical skirt 24 the interior of which is provided with screw threads 26 engageable with complementary threads 27 on the exterior of the neck 14 of the container 12.

The cap 18 has an inner coaxial skirt 28 which is connected at its upper end to the skirt 24 through means of an annular web 29. The lower end of the skirt 28 merges with another annular web 30 joined with a nozzle 31 forming a dispensing passage 32 which places the interior of the container 12 in communication with an opening 34 at the upper end of the nozzle 31.

Figure 3:
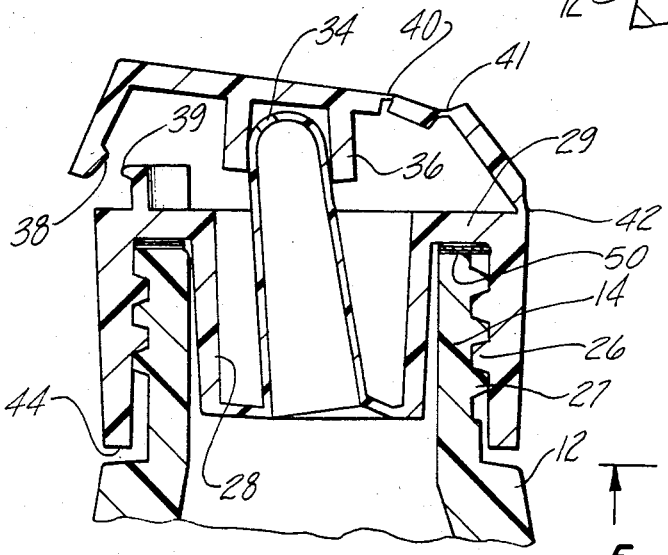
FIG. 3 is a view similar to FIG. 2 showing the closure in an unlatching and partially open position.
Figure 4:
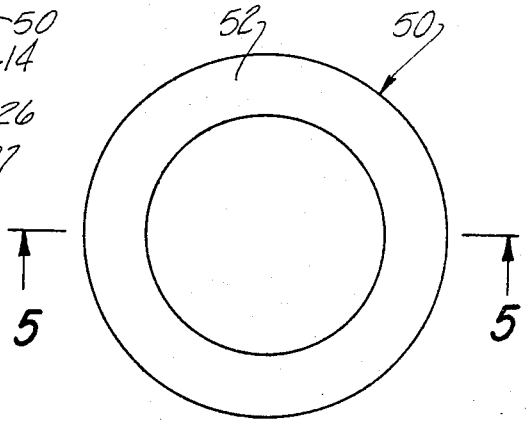
FIG. 4 is a plan view of a lock and seal element incorporated in the package.

The nozzle 31 is closed by a collar 36 formed at the underside of the lid 20 as seen in FIG. 1. The lid 20 is held in its closed position by a latch mechanism indicated at 38, 39 disposed diametrically opposite to the hinge 22. The hinge itself has hinged lines at 40, 41 and 42, which permits deflection of the lid 20 relative to the cap 18 as shown in FIG. 3 to cause disengagement of the latch 38, 39 after which the lid 20 can be swung to a fully open position about the hinge line 40 to uncover the opening 34 in the end of the nozzle 31 for dispensing the contents of the container 12.

A more complete disclosure of the container and closure described thus far can be found in U.S. Pat. No. 4,236,653. In that patent, the closure 16 is held in permanently attached relationship to the container 12 by means of one-way ratchet teeth not shown here but disposed between the closure and container adjacent to the lower lip 44 of the skirt 24. In the present embodiment of the invention, such structure is unnecessary and has been eliminated.

Figure 5:
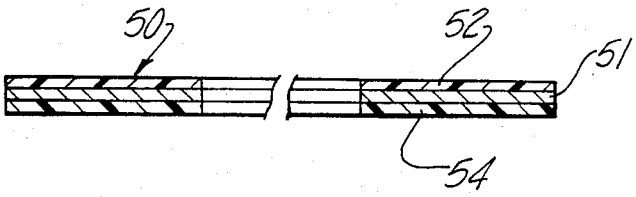
FIG. 5 is a cross-sectional view taken on line 5—5 in FIG. 4.

The closure 16 is permanently attached to the container 12 by a combined lock and seal element 50 which as seen in FIG. 5, is in the form of an annular element 51 of metallic, heat conductive material, such as aluminum. The metallic element can be very thin and preferably between 0.0003 inches and 0.003 inches. The upper surface of the lock and seal element 50 is coated with a layer 52 of material which when subjected to heat will fuse with the material from which the closure 16 is made. Similarly, the lower surface of the lock and seal element 50 is coated with a layer 54 of material which when subjected to heat, will soften and will fuse with the material from which the container 12 is made.

By way of example, the closure 16 may be made of a polypropylene material to afford flexibility and distortion for opening movement and the container itself could well be made of a polyvinylchloride. In that case, the aluminum ring 51 would have a lamination or layer 52 of material fusible with polypropylene and the opposite side would be coated with a lamination or layer 54 of (PVC) polyvinylchloride. Such facings are available in any combination to suit almost any common materials, including glass and most thermoplastics.

The laminated or layered lock and seal element 50 is positioned at the underside of the annular web 29 to fit between the interior of the skirt 24 and the exterior of the skirt 28. The lock and seal element 50 can be held in that position by wedging action or by the provision of separate protrusions on the skirts 24 or 28 which are not shown. The complete closure assembly 16 including the lock and seal element 50 can then be threaded into closed position on the container 12 to press the container 12 and closure 16 into tight engagement with opposite sides of the lock and seal element 50. This can be done manually or by automatic capping equipment. Thereafter, the package 10 with the container 12 filled with the intended contents can be moved through an induction field such as provided by apparatus indicated in FIG. 10. While the packages 10 move continuously on a conveyor 55, an induction heater 56 connected to a source of electrical energy not shown acts to heat the aluminum making up the annular ring 51 to cause the softening of layers 52 and 54 and the adjacent surfaces of the closure 16 and container 12, respectively, so that the surfaces weld together. The foil ring 51 serves as the heat generating member to uniformly and rapidly distribute the heat and cause softening of the layers 52 and 54. Both the power of the induction heater 56 and the duration of exposure of the package to the field control the temperature attained by the foil as well as the time that it remains heated. After the package 10 passes through the induction field, cooling occurs rapidly and a permanent connection is made between the container 12 and the closure 16. Not only is the connection permanent but it forms a seal which prevent leakage of liquids from the container 12 and requires that any removal of the containers contents be accomplished through the dispensing passage 32 and the opening 34.

The closure 16 is provided with a seal retaining lip 57 (not shown on drawings) which acts to hold the seal element 50 relative to the closure 16 prior to the time that the closure is applied to a container.

The complementary threads 26 and 27 form the useful purpose of applying mechanical pressure to opposite sides of the lock and seal element 50. However, such threads can be eliminated and replaced with snap or undercut retention means which serves to provide downward urging of the closure on the container during welding.

Although the package 10 has been described in connection with a container 12 and a closure 16 made of unlike materials, it should be understood that the invention has utility when the container 12 and closure 16 are made of like materials in which case, the layers 52 and 54 would be made of like materials. In that instance, a permanent lock is formed as well as a liquid tight seal.

Another dispensing package 58 employing the principles of the invention is disclosed in FIGS. 6 through 9. The package 58 includes a dispensing closure 60 which is fitted on a container 62, only the neck of which is shown. The closure 60 includes a lid 64 formed as a unit with the cap portion 66 by means of a live hinge 68. The top of the cap 66 is provided with an annular collar 70 forming a dispensing passage 72. In the closed position of the closure 60, the passage 72 is closed by a plug 74 formed on the underside of the lid 64.

As seen in FIG. 7, the closure 60 can be initially held on the container 62 by means of an annular collar 76 formed on the neck of the container 62 and a bead 78 formed at the open end of the cap 66. The collar 76 and bead 78 form a snap type connection and serve to hold the closure 60 and container 62 together initially to press a lock and seal element 80 between the container neck and underside of closure 60. In this instance, the lock and seal element is a disc of aluminum foil 82 opposite surfaces of which are provided with a layer 84 and 86 made of thermoplastic material which will melt and fuse with materials from which the closure 60 and container 62 are made.

The closure 60 is provided with an annular seal retaining head 88 by which the lock and seal 80 are held in temporary position relative to the closure 60 prior to its application of the entire closure assembly to a container.

After the container 62 is filled with its contents, a cap incorporating a lock and seal element 80 can be applied to the neck of the container 62 after which the package 58 can be passed through an induction field as described in connection with FIG. 10, causing the layers 84 and 86 to soften as well as the adjacent portions of the closure 60 and container 62. Upon cooling after leaving the induction field, the lock and seal element 80 forms a permanent fastener attaching to closure 60 to the container 62.

In this embodiment of the invention, the lock and seal element 80 extends over the entire opening in the container and in close proximity to the dispensing passage 72. Opening of the package 58 requires swinging of lid 64 to an open position to expose the dispensing passage 72. Subsequently, the lock and seal element 80 must be punctured or pierced by a tool such as the end of a pencil or a pen to open the dispensing passage to the contents of the container. The top surface of the cap 66 can be printed with an appropriate notice informing the user that if the lock and seal element 80 does not appear through the dispensing orifice, the package has probably been previously opened and possibly has been tampered with. In this manner, a tamper indicating feature is afforded.

With the lock and seal element 80 fused in position, a permanent connection is made which also acts as a fluid tight seal between the cap 66 and the container 62.

A lock and seal for a dispensing package has been provided by which a dispensing closure is permanently fastened to a container through means of a metallic disc coated on opposite sides with a polymer which is fusible with the material making up the closure and the container, respectively. Upon seating a closure on a container to clamp the seal element therebetween and the application of sufficient heat to bring the coating materials on the metallic element to a softened or melted condition, the materials fuse the container and closure to make a permanent lock and seal. Removal of the contents of the container thereafter requires dispensing through a dispensing passage in the closure. In on embodiment of the invention, positioning of the seal element adjacent to the closure affords tamper indicating features.

The embodiments of the invention in which an exclusive property or privilege is claimed are defined as follows:

1. A dispensing package comprising: a container having a neck portion forming an opening with a lip around the edge of said opening and means for attaching a closure thereto, a closure for covering said opening having complementary means for attachment to said container, a metallic seal member disposed between said closure and said lip portion and having an annular portion engaged with said lip and with said closure when said closure has been initially applied to said container by engagement of said attachment means, said annular portion of said seal member having a coating on one side surface of a material fusible with said container and a coating on the other side surface of said seal member fusible with the material of said closure when said seal member is subjected to heat, said seal member being fused to said closure and said container to form a permanent connection therebetween.

2. The dispensing package of claim 1 and further comprising a dispensing passage formed in said closure for communication with said container.

3. The dispensing package of claim 2 wherein said seal member obstructs said dispensing passage.

4. The dispensing package of claim 3 wherein said seal element is visible through said dispensing passage and is positioned in close proximity to said passage for piercing to obtain communication between said opening and said dispensing passage.

5. The dispensing package of claim 2 wherein said seal member is a ring positioned on the lip of said opening to afford communication between said container and said dispensing passage.

6. The dispensing package of claim 1 wherein said seal element includes an element made of aluminum.

7. The dispensing package of claim 1 wherein the thickness of said metallic seal member is substantially between 0.0003 and 0.003 inches.

8. The dispensing package of claim 1 wherein said closure is made of polypropylene and wherein said container is made of polyvinylchloride.

9. The dispensing package of claim 1 wherein said container is made of a 1st material and said closure is made of a 2nd material, said seal member being coated on opposite sides with materials fusible with said 1st and 2nd materials respectively.

10. A dispensing package comprising: a container having an externally threaded neck portion forming an opening with a lip around the edge of said opening, an internally threaded closure for covering said opening by engagement of said container and closure threads, a metallic seal member disposed between said closure and said lip portion and having an annular portion engaged with said lip and with said closure when said closure has been initially applied to said container by threading engagement, said annular portion of said seal member having a coating on one side surface of a material fusible with said container and a coating on the other side surface of said seal member of a material fusible with said closure when said seal member is subjected to heat, said seal member being fused to said closure and said container to form a permanent connection therebetween.

* * * * *